United States Patent [19]

Holtgreve

[11] Patent Number: 4,843,794

[45] Date of Patent: Jul. 4, 1989

[54] ROOFING SLAB

[75] Inventor: Johannes Holtgreve, Schwelm, Fed. Rep. of Germany

[73] Assignee: Johannes Klöber, Ennepetal, Fed. Rep. of Germany

[21] Appl. No.: 130,878

[22] Filed: Dec. 10, 1987

[30] Foreign Application Priority Data

Dec. 18, 1986 [DE] Fed. Rep. of Germany ..... 3643319

[51] Int. Cl.[4] ..... E04H 12/28; E04D 13/03; E04D 13/035

[52] U.S. Cl. ..... 52/199; 285/44

[58] Field of Search ..... 52/58, 60, 198, 199; 285/42–44; 126/314–317

[56] References Cited

U.S. PATENT DOCUMENTS

| | | | |
|---|---|---|---|
| 917,385 | 4/1909 | Wallace | 285/44 |
| 1,332,224 | 3/1920 | McHale | 285/44 |
| 1,430,068 | 9/1922 | Filkins | 52/58 |
| 1,442,625 | 1/1923 | Lyth | 52/58 |
| 1,703,670 | 2/1929 | Hoeft | 285/44 |

*Primary Examiner*—James L. Ridgill, Jr.
*Attorney, Agent, or Firm*—Martin A. Farber

[57] ABSTRACT

A roofing slab (1) has a roof lead-through in the form of a pipe (2) of adjustable inclination which extends from beneath the roofing slab to a point above it via a correspondingly dimensioned passage hole provided in the region of the vertex of a dome of the slab. The dome has a dome-shaped upper side and a form-fitting hood part (5) associated with the pipe. The hood part rests on the dome in secured fashion by an urging of the pipe, in the region of the lower side of the roofing slab, towards the roofing slab. An advantage from a structural and mounting standpoint is that the pipe (2) be formed in two parts with a place of coupling (K) above the hood part (5). In this way the pipe part (2') which serves the purpose in view can be very easily attached from the outside.

12 Claims, 3 Drawing Sheets

F
2'
7
6'
y
13
15
14
6
2''

X

2'
7
K
A
6
2
3
5
4'
4
10
12
P
11
1
8
16
2''
X

ROOFING SLAB

FIELD AND BACKGROUND OF THE INVENTION

The present invention relates to a roofing slab with roof lead-through in the form of a pipe of adjustable inclination which extends from the bottom of the roofing slab dimensioned passage hole in the region of the vertex of a dome having a cupola-shaped top. Furthermore, there is associated with the pipe a hood part of corresponding shape, a resting of the hood part on the dome being secured by urging the pipe towards the roofing slab in a region of the lower part of the roofing slab.

A roofing slab of this type is known from Federal Republic of Germany Utility Model 83 16 888.

In view of the different purpose of use of such roof lead-throughs, for instance for stove exhaust hoods, for venting and even for the passage of antennas, there is a considerable diversity in shape, even for parts which, based on their function, would not have to be included in the variation. Storage and shipment are correspondingly expensive.

SUMMARY OF THE INVENTION

It is the object of the present invention to create a roofing slab with roof lead-through of this type in the case of which the adaptation to a specific special purpose of use or configuration is achieved with the simplest means from a manufacture and mounting standpoint.

This object is achieved by the invention in which there is provided a roofing slab (1) with a dome and a roof lead-through in the form of a pipe (2) of adjustable inclination, which pipe extends from the bottom of the roofing slab to a point above the slab to provide a correspondingly dimensioned passage hole in a region of the vertex of the dome. The dome has a dome-shaped upper side and a form-fitting hood part (5) associated with the pipe. The hood part rests on the dome in secured fashion by urging the pipe, in the region of the lower side of the roofing slab, towards the roofing slab. A feature of the invention is attained by dividing the pipe (2) into two parts with a coupling place (K) above the hood part (5). Further advantageous features are described below.

As a result of this development, a roofing slab of this type is of increased value in use. Due to the fact that the pipe is now developed in two parts with a coupling place above the hood part, only the pipe part which is in accord with the purpose pursued need be attached. All other basic parts can remain unchanged. This is advantageous both for stocking and with respect to possible later changes, for instance in the manner that the roof lead-through is now used for the leading through of an antenna rather than as a vent device as previously. The mounting is limited to the eliminating of the coupling connection and the corresponding attachment of the other part. The place of coupling is freely accessible. As an advantageous further development, it is proposed that the hood part which is displaceable on the lower pipe part be acted on in the region of the place of coupling of the upper pipe part in the direction of clamping the application of hood part and dome against each other. As a result of suitable clamping, the inclination between roofing slab and pipe can be shifted and clamped fast by this means. With this development even the previously employed bonding of the hood part to the inward leading pipe can be dispensed with. The sealing problems inherent therein also no longer occur. Rather, the clamping pressure obtainable even favors the tight application of the parts which are coupled to each other. Specifically a solution is favorable in which the hood part forms a collar which is adapted to the cross section of the pipe and the end edge of which is acted on by a shoulder of the upper pipe part. The clamping stress flows equally into the end edge; no partial maximum stresses are produced. The corresponding annular wall of the collar can therefore also be kept very thin, which has a positive effect with regard to the saving of material, which is today of great interest.

Furthermore, it is advantageous that the upper pipe part can be screwed into the end of the lower pipe part. In this way, the simplest manner of coupling can be realized in practice and the clamping together adjusted precisely. It is advantageous from a structural standpoint for the shoulder to be formed by a wall offset. Due to the fact that the collar protrudes beyond the end edge of the lower pipe part, there is always an axial free clamping space which still permits additional clamping at any time. Finally, one advantageous feature resides in the fact that the lower end of the upper pipe part is forked with rotational symmetry. The upper end of the lower pipe part enters into the groove of the fork. The radial joint is in this way covered by a cap-shaped structural part, which therefore effectively prevents the penetration of rain water if the seat is not sufficiently tight. Water of condensation which precipitates within the pipe cannot pass to the outside of the pipe.

BRIEF DESCRIPTION OF THE DRAWINGS

The object of the invention is explained in further detail below with reference to an embodiments shown in the accompanying drawings, in which.

DETAILED DESCRIPTION OF THE PREFERRED EMBODIMENTS

Figures 1, 4:
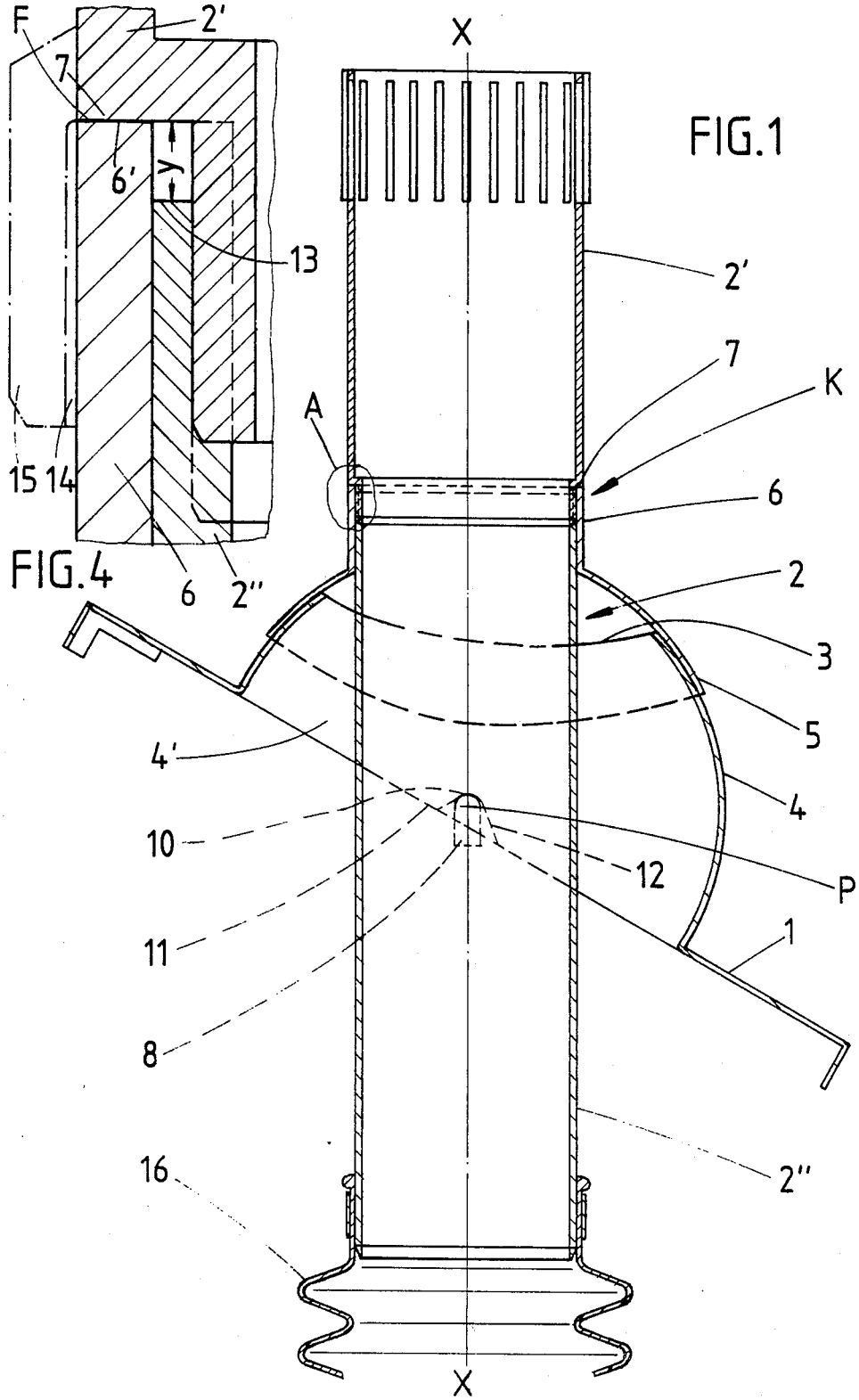
FIG. 1 shows the roofing slab of the invention with roof lead-through, seen in vertical section.
FIG. 4 is an enlarged view of the section designated A in FIG. 1 with variant shown in dash-dot line.

The roofing slab developed as roof lead-through is shaped basically like the other roofing slabs in order to assure an optically pleasing adaptation to the overall picture of the roof.

A pipe 2 serving, for instance, as vent passes through a passage hole 3 in the roofing slab 1. The hole is located in the region of the vertex of a dome 4 which is arched out towards the top of the roof and it is developed as a slot.

The dome 4 is arched in cupola shape on its top. The arch line extends, seen in the direction of inclination of the roofing slab 1, around a radius point P. The radius point lies a slight distance above the top of the roofing slab and intersects the longitudinal center axis x—x of the pipe 2.

Although the dome 4 could be entirely spherically shaped it is, however, pulled in parallel to the longitudinal edges 1' of the roofing slab 1, substantially to the dimension of the pipe diameter, so that the dome side walls 4' which form an elongated shaft rest snugly against the wall of the pipe 2 which is of circular cross section. The ends of the shaft together with the vertex region pass in a narrow arching into the side walls 4' of the dome.

The cupola-shaped top of the dome 4 is gripped over by a hood part 5 which is also passed through by the pipe 2. At least the inner side of said hood which rests on the cupolashaped top side is developed in form-fitting manner. The hood part 5 can thus be shifted, guided in the plane of inclination, practically in the manner of a ball joint and, thus the angle of inclination of the pipe with respect to the plane of the roofing slab can be adjusted corresponding to the length of the passage hole 3.

For the narrow guidance application of the pipe 2, the hood part 4 continues on the outside of the roof in a collar 6 which is adapted to the cross section of the pipe 2. The end edge of the collar is cut flat, i.e. it extends perpendicular to the longitudinal central axis x—x of the pipe 2.

The pipe 2 of adjustable inclination which extends from the bottom of the roofing slab 1 up to the top thereof is developed in two parts. The pipe part which is visible above the collar 6 bears the reference number 2' while the lower pipe part, which extends into the roof space, is designated 2".

The coupling place K which connects the two pipe parts with each other is located above the hood part 5 or, more precisely, within the region of the collar 6. Behind this collar which hides the place of coupling from view, the upper pipe part 2' is screwed into the corresponding end of the lower pipe part 2". The upper pipe part 2' is provided for this purpose with a corresponding external thread while the corresponding inner thread lies in the end of the lower pipe part 2".

Figure 2:
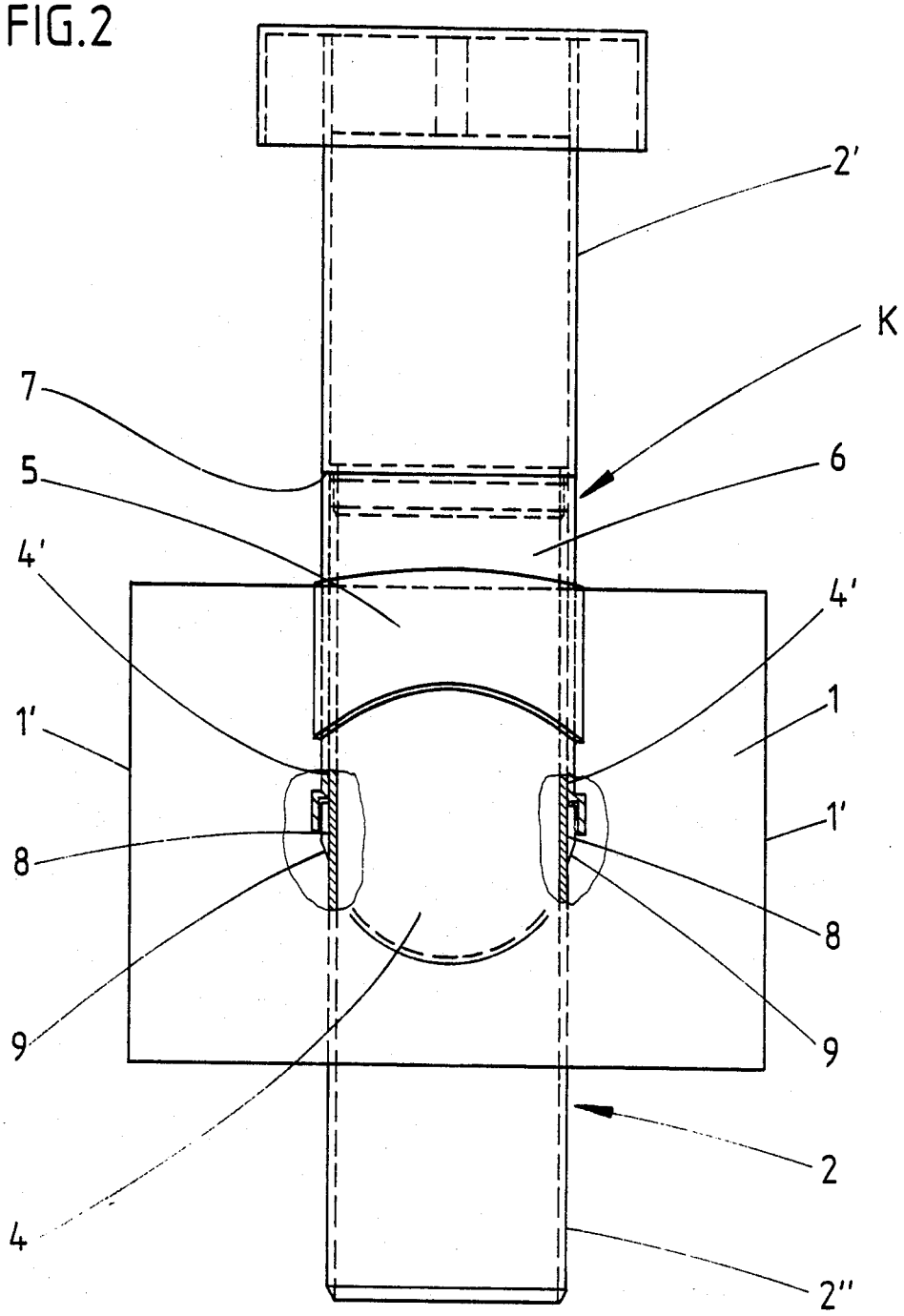
FIG. 2 is a left side view thereof, partially broken away and provided with a different upper end part.
Figure 3:
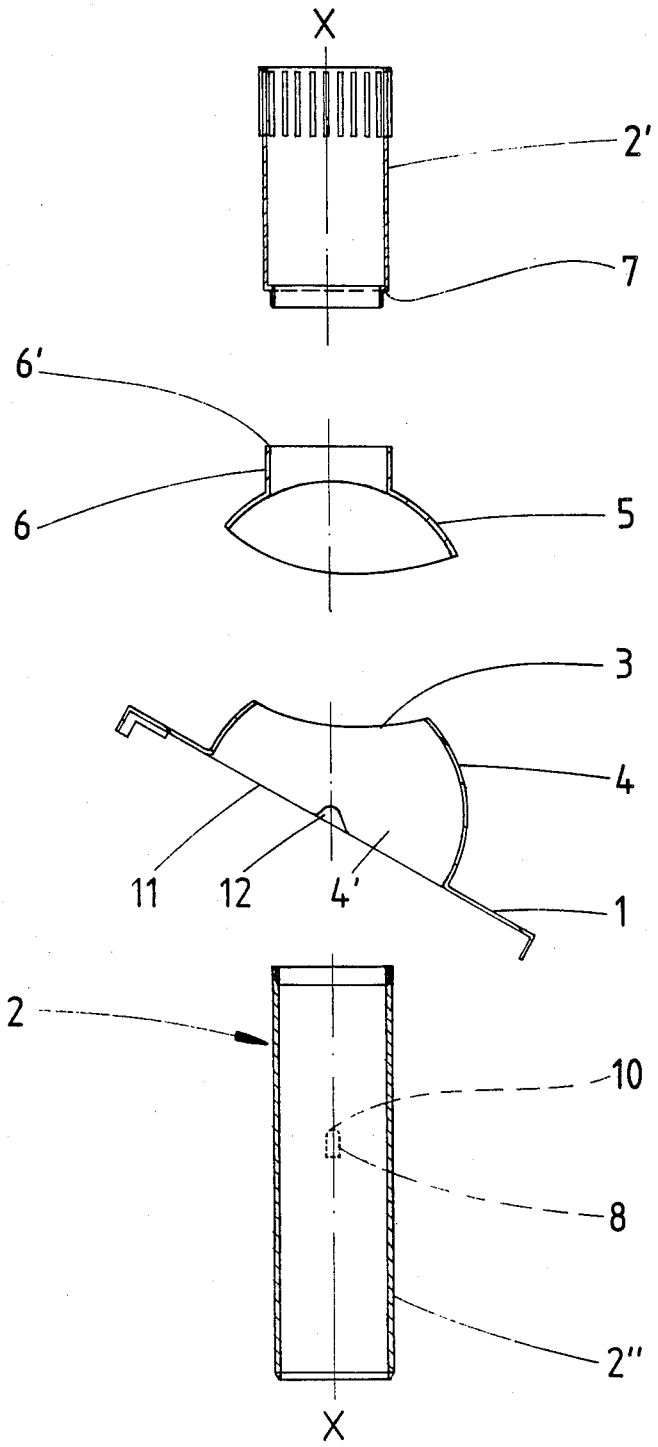
FIG. 3 shows the roofing slab with roof lead-through in an exploded view.

In this way the upper pipe part 2' can not only be attached by manual turning but if necessary it can also be refitted. Thus an end piece which is open on top, provided with ample venting slits and serving as cooking range exhaust (see FIG. 1) can easily be replaced by an end piece which has a cap (see FIG. 2). Beyond this possibility of variations, a roof lead-through which is not associated with the ventilation problem can also be used, for example, an antenna line. In such case an antenna hood having the corresponding attachment screw-thread is then screw in here.

Among other purposes for the supporting of the pipe 2 on the collar 6, an annular shoulder 7 of the upper pipe part 2' comes against the corresponding end edge 6' of this collar 6. This should 7 is obtained by a wall offset. The shoulderforming projection corresponds essentially to the wall thickness of the pipe or is slightly above. On the outside the wall surface of the pipe part 2' is flush with that of the collar 6.

As an advantageous further development, the shoulder 7 and the screwability of the pipe parts are used to participate in the formation of a displacement and locking device for the varying of the inclination of the pipe 2. This is done by clamping the dome 4 between the two pipe parts with inclusion of the hood part 5. In order to create the necessary support for this on the roof panel bottom side with respect to the lower pipe part 2', holding ribs 8 extending on the outside beyond the outer wall of this pipe part are formed on said pipe part. These ribs are in diametrical opposition at the same height to each other and extend axially. For facilitated plug connection, the end which is directed towards the inside of the roof forms a runon bevel 9 (see FIG. 2). The other end of the holding ribs 8 forms a convexly rounded end surface 10 which extends into the plane of swing of the pipe.

The end surfaces 10 of the holding ribs 8 lie against the bottom 11 of the roofing slab 1, namely in the region of the dome side walls 4' which participate in forming the vertical guide shaft. In the central tangent zone, these dome side walls 4' form a mounting trough 12 which is open in the direction of the shaft and downward. The mounting trough 12 has a trough bottom which corresponds to the circular curvature of the end surface 10 but which, as a result of the diverging course of the adjoining trough flanks, experiences in practice a funnel-shaped widening the angle of which takes into account the region of displacement of inclination of the pipe 2. In order to remain with the relatively slight wall thickness, the mounting trough can be produced by peripheral wall offset of the support-forming parts of the side walls 4'.

The arched end surface 10 extends transverse to the longitudinal center axis of the pipe 2, the flanks of the support trough 12 extending in the same manner. In this way, a hook-like supporting of the pipe 2 is practically achieved on the bottom of the roofing slab.

This and the further development to the effect that the collar 6 protrudes beyond the end wall 13 of the lower pipe part 2" permit the roofing slab 1 hooked on the pipe to be pulled over the shoulder 7 directed axially against the hood part 5 which extends over it, so that finally the collar 6 thereof is clamped by its end wall 6' against the shoulder 7. The frictional application between the inside of the hood part 5 and the outside of the dome 4 can thus be varied up to complete clamping closure. The collar is adapted to the corresponding displaceability of the lower pipe part 2". The required securing against turning of the lower pipe part 2" with respect to the upper pipe part 2' results from the lower supporting engagement between the holding ribs 8 and the support trough 12. The axial clamping free-path y obtained from the difference in length explained can be noted from FIG. 4. The maximal clamping dimension is exhausted when the edge 13 has come against the shoulder 7.

In order to obtain a tight closing between the two pipe parts 2', 2" the lower end of the upper pipe part 2' is forked with rotational symmetry. The collar and the threaded section of the lower pipe part 2" enter into the downwardly open space 14 created in this manner. There is thus obtained here a multi-wall, stable attachment. The annular wall-like peripheral fork leg 15 acts like a protective screen. The joint is designated F. Shoulder 7 and end wall 6' could for this purpose also be cut conically with upward directed convergence of their ring flanks.

To the lower end of the lower pipe part there is connected an accordion body 16 as connecting hose for another pipeline.

I claim:

1. A roofing slab comprising:

a dome, a hood part, and a roof lead-through in the form of a pipe having adjustable inclination relative to the slab, the pipe extending from a point beneath the roofing slab to a point above the slab via a correspondingly dimensioned passage hole provided in a region of the vertex of the dome, there being a dome-shaped upper side to the dome for receiving the hood part in form-fitting manner, the hood part encircling the pipe; and wherein the pipe is divided into a lower and an upper pipe part by a coupling place located above the hood part;

said slab further comprising means at said coupling place for securing said lower pipe part on the lower side of the slab to the hood part and to said upper pipe part, a top of said lower pipe part being joined to a bottom of said upper pipe part; and wherein a resting of the hood part on the dome is secured by said securing means.

2. A roofing slab according to claim 1, wherein the hood part is displaceable on the lower pipe part; and the hood part is clamped in the region of the coupling place by the securing means against the upper pipe part and the dome.

3. A roofing slab according to claim 1, wherein said securing means provides for the upper pipe part to be screwed into the end of the lower pipe part.

4. A roofing slab according to claim 1, wherein a lower end of the upper pipe part is formed with rotational symmetry.

5. A roofing slab according to claim 1, wherein said securing means provides for a screwing together of the upper and the lower pipe parts to maintain a clamping position, the clamping position securing alignment of the pipe to the slab.

6. A roofing slab according to claim 1, wherein at said coupling place, a first of said pipe parts comprises a shoulder which extends past a second of said pipe parts to permit a selective displacement of said second pipe part relative to said first pipe part and said hood part.

7. A roofing slab according to claim 6, wherein said shoulder is formed on said upper pipe part.

8. A roofing slab according to claim 1, further comprising receivers on side walls of said dome, and roofing slab-side holding ribs are formed on diametrically opposite sides of said lower pipe part and rest, forming a joint, in said receivers.

9. A roofing slab according to claim 8, wherein said holding ribs and said receivers are formed with complementary circular curvatures.

10. A roofing slab according to claim 1, wherein the hood part includes a collar commensurate with the cross section of the pipe, the collar having an end edge which abuts a shoulder of the upper pipe part.

11. A roofing slab according to claim 10, wherein the shoulder is formed by a wall offset of the pipe.

12. A roofing slab according to claim 10, wherein the collar protrudes over an end edge of the lower pipe part.

* * * * *